US006418637B1

(12) United States Patent
Ahvenainen

(10) Patent No.: US 6,418,637 B1
(45) Date of Patent: Jul. 16, 2002

(54) METHOD OF SEALING A ROTARY DRUM CONNECTION

(75) Inventor: Arto Ahvenainen, Varkaus (FI)

(73) Assignee: Andritz-Ahlstrom Oy, Helsinki (FI)

( * ) Notice: Subject to any disclaimer, the term of this patent is extended or adjusted under 35 U.S.C. 154(b) by 0 days.

(21) Appl. No.: 09/341,188

(22) PCT Filed: Jan. 7, 1998

(86) PCT No.: PCT/FI98/00013

§ 371 (c)(1),
(2), (4) Date: Jul. 6, 1999

(87) PCT Pub. No.: WO98/30818

PCT Pub. Date: Jul. 16, 1998

(30) Foreign Application Priority Data

Jan. 7, 1997 (FI) ..... 970076

(51) Int. Cl.[7] ..... F26B 5/04

(52) U.S. Cl. ..... 34/417; 34/427; 277/358; 277/391; 277/903

(58) Field of Search ..... 34/402, 417, 427, 34/242; 277/358, 361, 362, 377, 391, 903

(56) References Cited

U.S. PATENT DOCUMENTS 4,392,823 A * 7/1983 Weber et al. ..... 432/114

5,567,380 A * 10/1996 Hoover ..... 266/173

FOREIGN PATENT DOCUMENTS

| | | |
|---|---|---|
| DE | 1078041 | 3/1960 |
| FR | 1402337 | 5/1965 |
| GB | 855040 | 11/1960 |
| GB | 1517939 | 7/1978 |
| GB | 2022196 | 12/1979 |

* cited by examiner

*Primary Examiner*—Pamela Wilson
(74) *Attorney, Agent, or Firm*—Nixon & Vanderhye P.C.

(57) ABSTRACT

A sealing arrangement is provided between a rotary drum kiln and the stationary end thereof arranged in a material flow relation to each other, having enhanced effectiveness and requiring less maintenance. Pressurized gas, such as air, is fed to the connecting area of the drum and stationary end so that the angle α between the feeding direction of the gas and a plane substantially perpendicular to the center axis of the rotary drum is 90° or less (preferably between about 10–30°). The air flow is directed to the seal in such a way that it prevents leaking of process gas and solid matter dust from the connecting point of the rotary drum and the feed chamber, and so that as little air as possible escapes to the surroundings. Due to the gas flow, the stationary surface and the moving surface substantially do not rub together.

7 Claims, 5 Drawing Sheets

METHOD OF SEALING A ROTARY DRUM CONNECTION

CROSS-RELATED TO RELATED APPLICATION

This application is a U.S. national phase of International Application No. PCT/F198/00013 filed Jan. 7, 1998.

BACKGROUND AND SUMMARY OF THE INVENTION

The present invention generally relates to a sealing arrangement between a rotary drum and the stationary end chamber thereof, especially a feed chamber. The function of the sealing arrangement is to prevent the access of gas from the surroundings and, on the other hand, the escape of process gas or other material, such as dust, to the surroundings in the connecting area of the rotary drum and the stationary chamber. Especially, these kinds of apparatus include rotary drum kilns and rotary drum driers, in which one end of the rotary drum is encircled by a stationary chamber for feeding of the material to be treated into the drum and the other end by a chamber for removing material.

The sealings of the ends of rotary drum driers are usually either so called labyrinth sealings or mechanical sealings having a seal ring that slides against the end of the kiln, hereinafter called mechanical sealings. The former are non-contacting sealings, the parts of which are formed in such a way that the flow resistance through the sealing is as great as possible. They are not totally tight, and thus gases and dust most often escape to the surroundings to some extent. In general, they are used when the pressure lower than the pressure of the surroundings prevails in the drum and when the conditions in the drum allow a small leakage from the surroundings into the kiln.

Better tightness is pursued by means of mechanical sealings, which are used in more demanding conditions, for example when reducing conditions prevail in the kiln and an air leakage through the sealing into the inside of the kiln would cause undesirable combustion reactions in the proximity of the leakage point.

Although having a simple structure, a labyrinth sealing is not applicable to all objects. A mechanical sealing, in turn, is more expensive and needs to be maintained significantly more often, as the slide surface needs to be lubricated in order to prevent or delay the wearing thereof. In the applications in which the dust in the kiln causes wearing, the sporadic access of dust onto the slide surfaces increases the wearing of the surfaces despite the lubrication, causing thus even a significant increase in the need of maintenance.

In causticizing plants of sulphate pulp mills, the lime is regenerated in rotary drum kilns. The recent development of the regeneration process has, however, led to situations where the area of the feed end of the kiln operates at a very high degree of feeding. Consequently, dry feed material (so called lime sludge) often gets out through the sealing and causes significant damage in the surroundings of the kiln due to excessive dusting. This happens despite the fact that in the area of the feed end of the drum at the point of the sealing there is a lower pressure inside the drum than in the surroundings. The dust leakage takes place because the particle size of lime sludge is very small, on average 10–20 $\mu$m. Hereby, when being in movement, the lime sludge flows like water, penetrating the sealing.

During the operation of a rotary drum, for example a rotary drum kiln, the end of the drum does not stay in position but moves in the direction of the axis of the drum to the extent of the longitudinal thermal expansion of the drum shell. The bend of the end of the drum depends upon the load it carries, which load varies according to the degree of feeding of the drum. It also has a radial displacement, the size of which is usually, depending upon the accuracy of manufacture, a few or a few tens of millimeters. All these factors have to be taken into account in a sealing arrangement.

An object of the present invention is to create a sealing arrangement between the rotary drum and the stationary end chamber thereof arranged in a material flow relation with each other, which arrangement would be better than the known ones. The need of maintenance of such an arrangement is smaller than with sealings generally in use, such as with mechanical sealings, in which the moving and stationary parts of the sealing rub together. By means of the arrangement, the leaking of gas and solid matter (dust) is also prevented.

The invention relates to a method of preventing leakages of gas and solid matter dust by using pressurized gas, such as air, at the connecting point of a rotary drum and a stationary end chamber, such as a feed chamber, at the end of which drum there are a vertical end surface and an opening through which the drum is connected to the stationary chamber. What is essential for the method is that pressurized gas is fed on the end surface of a rotary drum toward the center axis of the drum in such a way that the angle ($\alpha$) between the feeding direction of the gas and the plane substantially perpendicular to the center axis of the rotary drum is 90° or less, and in such a way that, due to the effect of the gas flow, the end surface of the drum is located at a distance from the stationary surface, whereby they do not substantially rub together in a wearing way.

The present invention also relates to a sealing arrangement defined in the appended claims.

The present invention is based on the use of pressurized gas, such as air, which is guided to the sealing in such a way that it prevents the leaking of the gas and solid matter dust from the connection point of a rotary drum kiln, and a stationary chamber, such as a feed chamber of a rotary drum kiln, and that as little air as possible is directed from the sealing out to the surroundings. Furthermore, due to the effect of the gas flow, the pressure of the gas pushes the countersurfaces of the rotary drum and the end chamber away from each other. Thanks to the air-floating brought about in this way, the countersurfaces of the rotary drum and the stationary system (feed chamber, sealing rings) do not rub together, at least not in wearing way. The advantageous aspect of the method according to the invention is that the sealing air flow required can be generated at an overall efficiency of a few kilowatts by means of a simple blower.

The sealing according to the invention operates well when said angle is 90°, but thus the required amount of sealing gas is larger than with smaller angles. The sealing gas flow typically divides in two directions, i.e. to a blow inward into the sealing and to a leakage away from the sealing. When said angle is a right angle, the sealing gas flow is divided in such a way that about half of it flows out. Not even in a case like this is a large total amount of gas required, and thus this can be regarded as a completely satisfactory arrangement. It is advantageous that the sealing does leak outward to some extent, because thereby it can be ensured that there is no excessive leakage of ambient air to the process.

The energy of the gas can be most effectively guided to prevent the penetration of the solid matter dust through the sealing of the connection point by directing the sealing air or other sealing gas obliquely, i.e. in such a way that said angle is below 90°. The oblique direction also prevents the air from passing outward from the sealing and becoming wasted air which does not contribute to the sealing process. The smaller the angle between the radius of the drum and the direction of air on the plane passing through the radius and the center axis of the drum is, the better the direction of air. The angle is below 90°, preferably about 5° to about 60°, most preferably about 10° to about 30°. However, the smaller the angle α is, the higher the sealing structure becomes in the direction of the radius, and also the bigger the weight and the higher the price. Hence, the size of the angle has to be optimized in each case separately. The sealing arrangement in which a significant part of the gas, for example 30% or more, flows outward from the sealing, may be quite satisfactory, in particular if it is cost-effective.

The present invention may also be applied to various apparatus comprising a rotary drum and a stationary end chamber arranged in a material flow relation with each other. A conventional apparatus included in this group is a horizontal rotary kiln which is used for calcination for example in chemical pulp and cement industry and in which the dust leakages to the surroundings of the kiln are a significant problem. These kinds of kilns are also used in other combustion processes. Drum applications are in general used in the following operations: heating/cooling of material, phase transition (e.g. evaporation of liquid), and chemical reaction (e.g. reduction and calcination). This group includes rotary driers, rotary coolers for hot material, reduction kilns, calcinators etc.

BRIEF DESCRIPTION OF DRAWINGS

The invention is illustrated in more detail with reference to the appended figures, in which FIG. 1 schematically illustrates a longitudinal cross-section of one end of a rotary drum kiln and a stationary feed end, to the connecting point of which the present invention is applied.

DETAILED DESCRIPTION OF THE DRAWINGS

Figure 1:
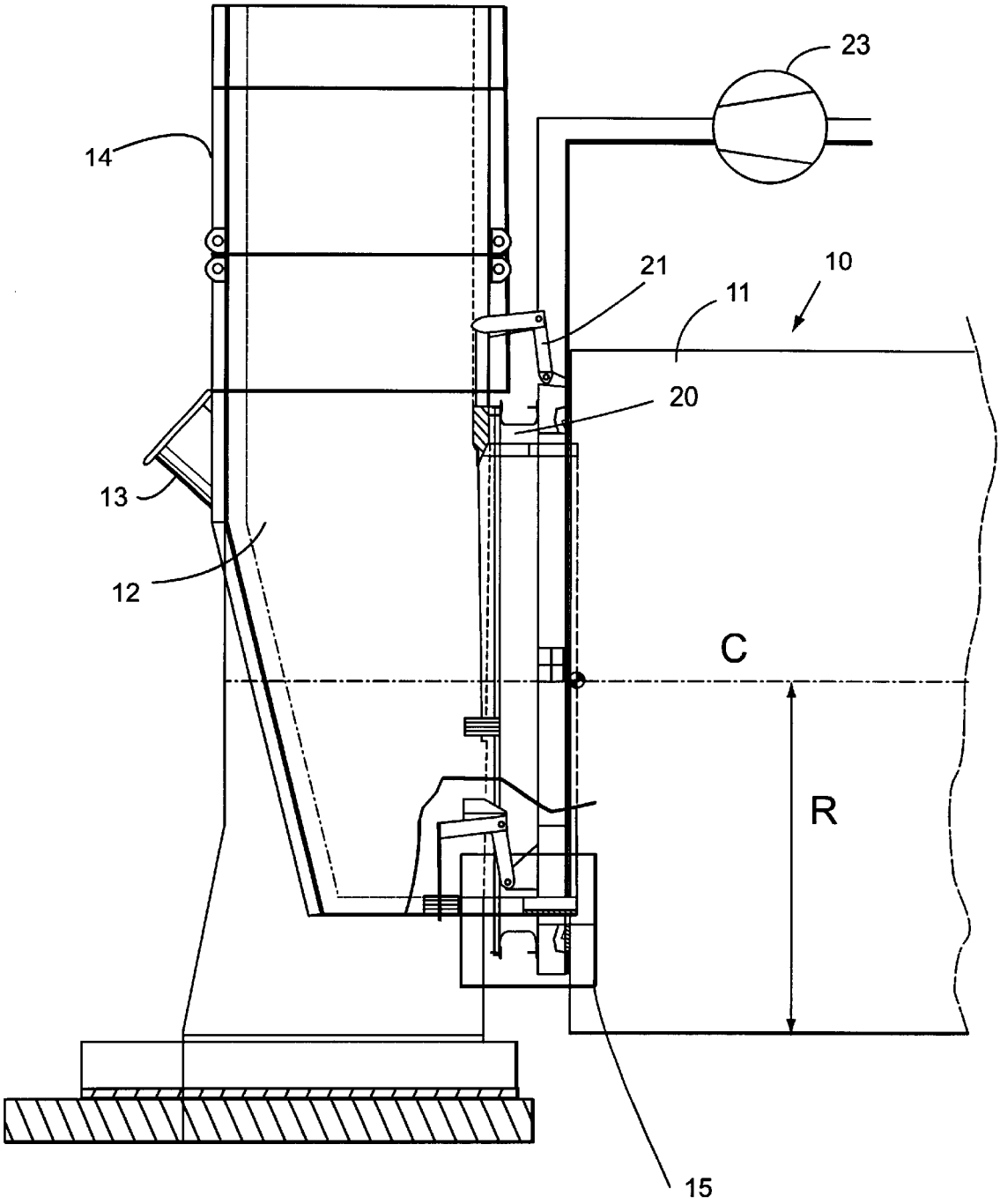

FIG. 1 shows the end on the side of the feed apparatus of the material in a rotary drum kiln 10. A kiln like this is used in the lime calcination and the manufacture of cement, for example. The rotary kiln comprises a horizontal, elongated rotary drum having a cylindric shell 11, which rotates in relation to a stationary feed chamber 12 of the material and to the discharge end (not shown) of the material at the opposite end of the drum. The drum is horizontal or positioned gently inclined in a manner known as such. The material is fed into the chamber 12 through a channel 13. The flue gases flow in the opposite direction relative to the material to be treated and are discharged through the upper part 14 of the feed chamber.

A sealing as gas- and dust-tight as possible has to be arranged on the stationary surfaces of the feed chamber in connection with the rotary countersurfaces of the rotary drum. A sealing arrangement in accordance with the invention is generally denoted by reference numeral 15 in FIG. 1.

Figure 3:
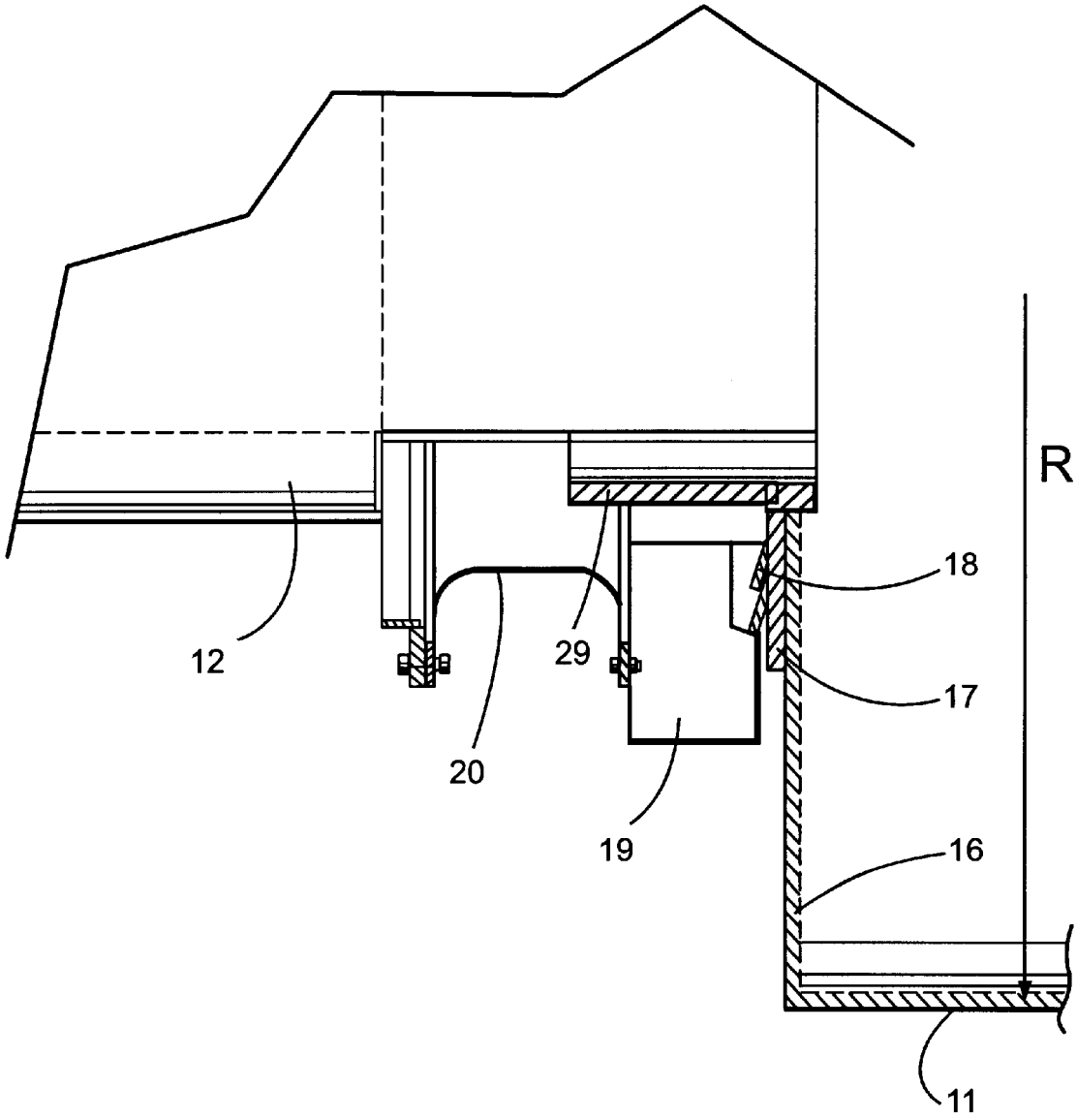
FIG. 3 illustrates a cross-section of a sealing arrangement in accordance with the present invention, said sealing arrangement being used in FIG. 1.
Figure 4:
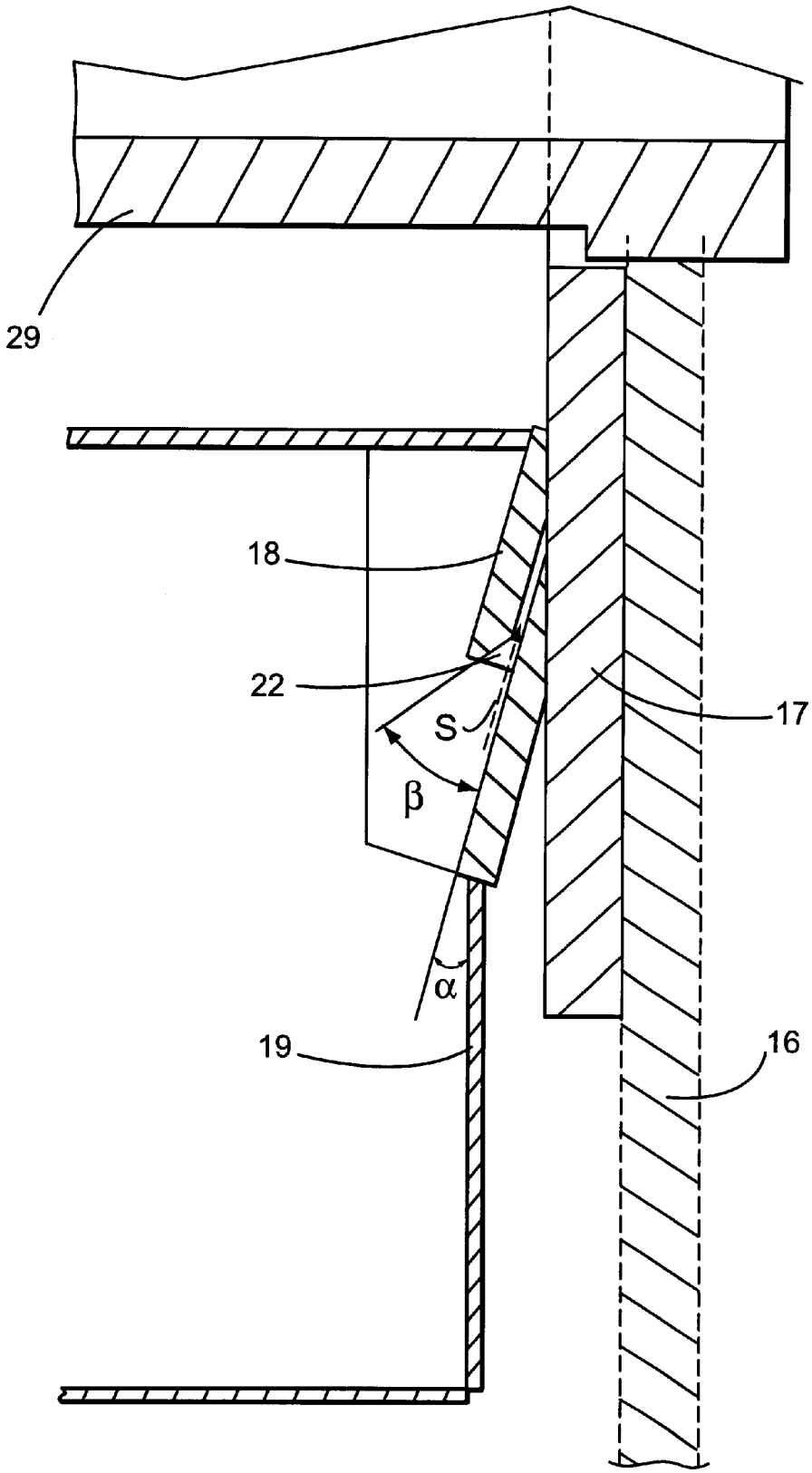
FIG. 4 illustrates a partial blow-up of FIG. 3.

One sealing arrangement in accordance with the invention has been disclosed in more detail in FIGS. 3 and 4. The end 16 of the drum 11 is machined vertical, whereby the axial displacement thereof can be eliminated. A ring 17 made of wear-resisting material has been attached to the end of the drum, the countersurface of which is machined, if needed, in the corresponding way, toward the drum. In other words, the ring 17 rotates along with the drum. Reference numeral 29 denotes the kiln neck connected to the opening at the end of the kiln shell. The extension of the feed chamber extends as far as to the kiln neck.

Figure 2:
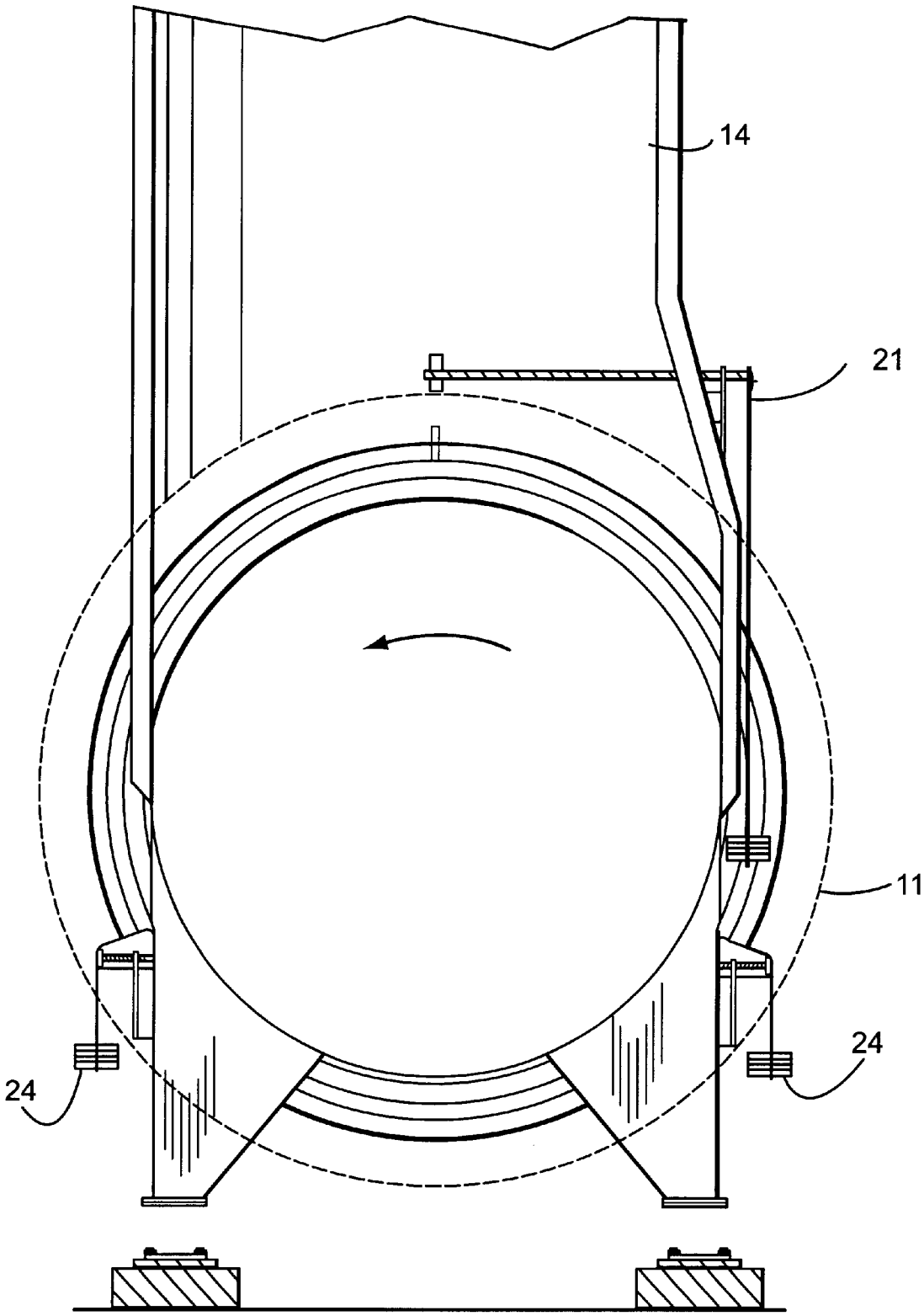
FIG. 2 illustrates an apparatus in accordance with FIG. 1 viewed from the end.

By means of a counterweight system 21 (FIGS. 1 and 2), a stationary sealing ring 18 (FIG. 3, FIG. 4) is pressed against the ring 17 and thus also against the end 16 of the drum, which sealing ring comprises at least one blow hole 22. The hole is shaped as a circle or a polygon. It is directed obliquely in the direction of the radius R of the drum toward the center axis C of the drum 11 and gas is blown through it toward the inside of the kiln. In the plane passing through the radius and the longitudinal axis of the drum, an angle α is formed between the blow hole 22 (and also the feeding direction S of the air) and the vertical plane being perpendicular to the center axis and passing through the radius R of the drum.

One essential feature of a preferred embodiment of the invention, namely the oblique direction of the blow hole, brings about many advantages. In this way, the energy can be guided in the best possible way to prevent the penetration of gas and dust out of the sealing. The oblique direction also decreases or prevents the passing of air through the sealing back outward, where it would become wasted air not contributing to the sealing process. The smaller the angle α is, the better the direction of air from the point of view of the functioning of the sealing. In the arrangement according to the figures, the angle α is about 15° (FIG. 4). In practice, the technical factors of manufacture determine how small the size of the angle is preferably adjusted. In any case, the angle α has to be below 90°. Preferably, it is about 5° to about 60°, most preferably about 10° to about 30°.

The angle β of the blow hole is typically 25–45°. The object of the bevelling is to decrease the inflow loss of the sealing gas out of the air distribution box into the hole, in other words to decrease the energy consumption of the sealing gas.

The sealing ring 18 is attached gas-tightly into an annular air distribution box 19, into which the sealing air or other gas is directed from an air blower 23 or other source of pressurized gas. The air distribution box, for its part, is attached by means of a flexible sealing bellows 20 or other sealing and flexible structural arrangement to the stationary feed end 12. The sealing bellows is made of material resistant to high temperature and dampness.

The sealing ring 18 is detached from the countersurface of the rotary drum, i.e. from the ring 17, by the pressure of the sealing air. The excessive growing of the distance or spacing formed hereby is prevented by means of the counterweight system 21 in such a way that by adding weights 24 the sealing ring 18 is pressed substantially against the countersurface, using, however, so little force that virtually no wearing of the surfaces results. The sealing ring 18 and the distribution chamber 19 of sealing air are supported against the feed end 12 by means of the structures of the counterweight system 21 in such a way that the sealing bellows 20 does not have to carry their weight.

Figure 5:
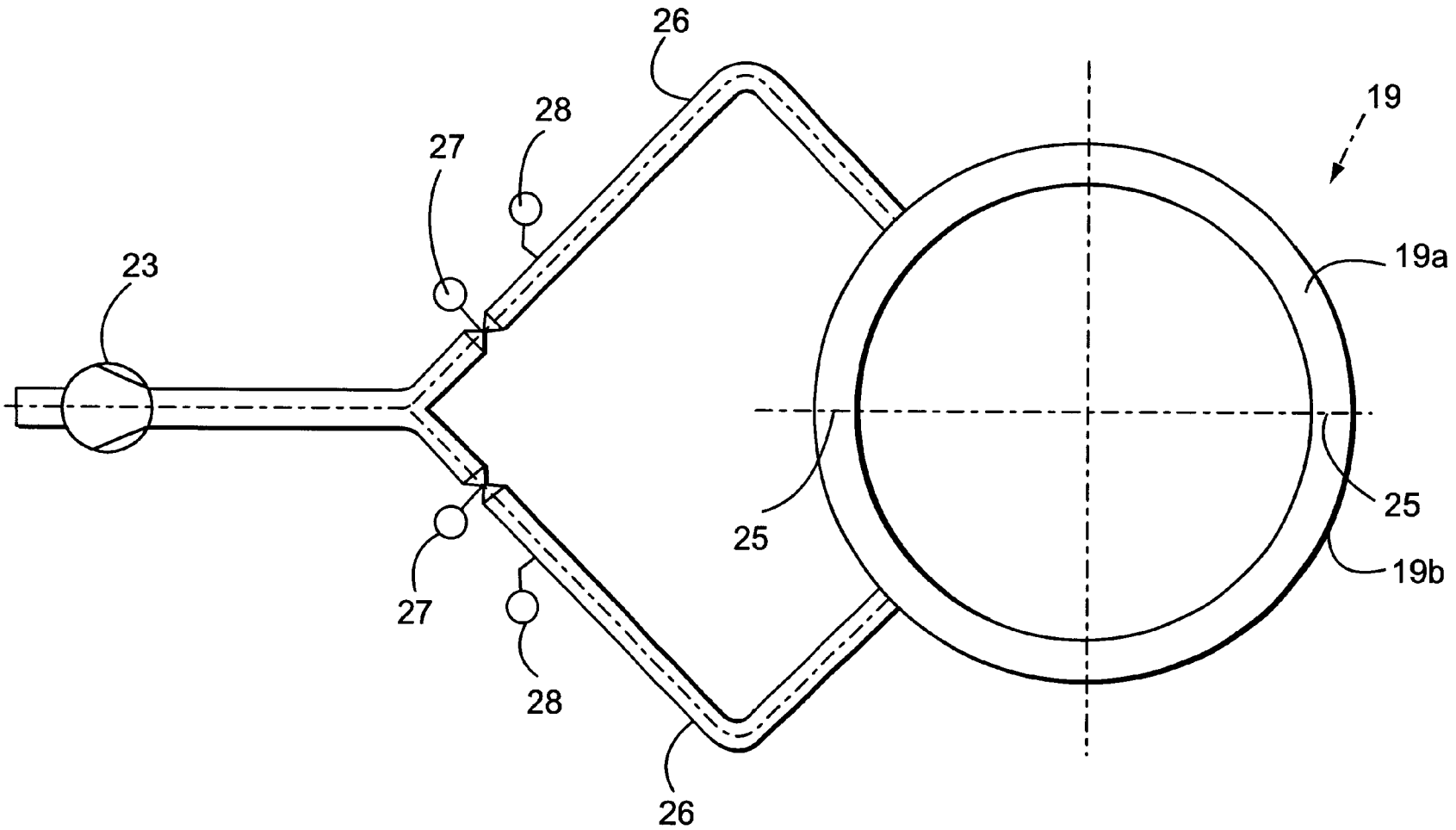
FIG. 5 illustrates the connection of a sealing air line.

Dust leakages through the sealing usually take place in the area of the lower part of the sealing. Hereby, there is a risk that sealing air escapes through the upper part of the sealing, where the additional flow resistance caused by the dust bed is absent or is significantly smaller than in the lower part. Escaping of sealing air in this way can be prevented or at least decreased by dividing the annular air distribution box 19 into two halves. FIG. 5 illustrates such an arrangement. The air distribution box is divided into two halves 19*a* and 19*b,* into which the sealing air is guided through separate supply pipes 26 comprising valves 27 and pressure indicators 28 for controlling the air flow. The air that is directed to the upper part 19*a* is at a lower pressure than the air directed to the lower part 19*b*. If it is desirable to adjust the conditions at different points of the sealing ring in more detail, the chamber 19 may be divided by partition walls into even more parts.

The sealing arrangement may also be arranged on the cylindric part of the rotary cylinder end. This arrangement may, however, be less advantageous, while the rotary countersurface (ring 17) and the sealing ring 18 would rub together to a greater extent as a result of the radial displacement of the cylinder. In addition, the sealing bellows has to compensate not only the axial movement of the cylinder but also the radial displacement, and moreover, the supply of air into the distribution chamber 19 has to be arranged by means of flexible elements.

The present invention provides a method more reliable than the former ones of preventing the gas and dust leakages from the connecting point of a stationary member and a rotary member, such as a drum. By directing the gas flow in a particular way (angle $\alpha$) it is possible to make the sealing gas flow in the desired direction. By directing the sealing gas at an overpressure preferably obliquely to the sealing of the connecting point, the possibility of such flows is significantly decreased. The sealing arrangements applying the principle of the invention also require very little maintenance compared with for example mechanical sealings usually used in this connection. In the sealing arrangement according to the invention, the stationary surface and the rotary surface do not rub together in a manner that would be substantially wearing (the countersurfaces do not actually come into contact with each other, at most they only touch each other very lightly from time to time). The spacings between the countersurfaces are adjustable. Also, the delivery, use and maintenance costs of the sealing arrangement are low.

What is claimed is:

1. A method of substantially preventing leakage of gas and solid matter dust at the area of connection between a rotary drum and a stationary end chamber having a stationary surface, the rotary drum having a center axis, and at the area of connection having a substantially vertical end surface and an opening providing communication with the stationary end chamber, comprising:

(a) directing pressurized gas on the end surface of the drum toward the center axis so that an angle $\alpha$ between the feed direction of the pressurized gas and a plane perpendicular to the center axis is no greater than 90°, and so that the pressurized gas flow maintains the end surface spaced from the stationary surface so that the end and stationary surfaces do not rub together in a manner causing wear.

2. A method as recited in claim 1 further comprising (b) feeding lime through the rotary drum and end chamber.

3. A method as recited in claim 2 wherein (a) is practiced to introduce the pressurized gas at an angle a of between about 10–30°.

4. A method as recited in claim 1 wherein (a) is practiced to introduce the pressurized gas at an angle $\alpha$ of between about 5–60°.

5. A method as recited in claim 1 wherein (a) is practiced to introduce the pressurized gas at an angle a of between about 10–30°.

6. A method as recited in claim 1 further comprising (b) adjusting the distance the end surface is spaced from the stationary surface.

7. A method as recited in claim 1 wherein (a) is practiced by providing a stationary sealing ring comprising the stationary surface of the end chamber, the stationary sealing ring having at least one blow hole formed therein; and directing pressurized air as the pressurized gas through the at least one blow hole.

* * * * *